United States Patent [19]

Flower

[11] 4,160,436

[45] Jul. 10, 1979

[54] ROTARY VALVES

[76] Inventor: Ralph F. J. Flower, Littledean, Bath Rd., Devizes, Wiltshire, England

[21] Appl. No.: 889,130

[22] Filed: Mar. 22, 1978

[30] Foreign Application Priority Data

Mar. 25, 1977 [GB] United Kingdom ..... 12761/77

[51] Int. Cl.[2] ..... F01L 7/16; F16K 25/00; F16C 11/06

[52] U.S. Cl. ..... 123/190 B; 123/190 DL; 123/190 E; 123/80 R; 251/367; 403/121

[58] Field of Search ..... 123/190 R, 190 B, 190 DL, 123/190 E, 80 R; 251/367; 16/128 R, 128 B; 403/55, 121

[56] References Cited

U.S. PATENT DOCUMENTS

| | | | |
|---|---|---|---|
| 3,990,423 | 11/1976 | Cross et al. | 123/190 E |
| 4,010,727 | 3/1977 | Cross et al. | 123/190 B |

FOREIGN PATENT DOCUMENTS

| | | | |
|---|---|---|---|
| 1471533 | 4/1977 | United Kingdom | 123/190 R |
| 1478982 | 7/1977 | United Kingdom | 123/190 B |
| 1481803 | 8/1977 | United Kingdom | 123/190 B |

*Primary Examiner*—Charles J. Myhre
*Assistant Examiner*—M. Moy
*Attorney, Agent, or Firm*—Emory L. Groff, Jr.

[57] ABSTRACT

A rotary valve for controlling the flow of fluids, and especially the gases in an internal combustion engine. A rotatable valve member is housed in a bore defined by a two-part housing interconnected by an element serving as a hinge to allow relative movement between the housing parts about an axis parallel to the rotary axis of the valve member. The element also allows the two housing parts to move relatively to adjust differentially the separation thereof at the two ends of the bore housing the valve member. The element may be in the form of a pair of semi-circular pins, or in a ball-and-socket joint.

14 Claims, 15 Drawing Figures

ROTARY VALVES

BACKGROUND OF THE INVENTION (a) Field of the invention.

This invention relates to improvements in rotary valves, for example for use in engines such as internal combustion or compression ignition engines, pumps, compressors, and so on.

(b) Description of the prior art.

It has been proposed by M. E. Cross and A. E. Coles to improve and modify an original design of rotary valve invented by R. C. Cross, as described in Specifications of British Patents Nos. 1473107, 1478982, 1481802 and 1481803. In these proposals a two part housing is provided for the valve comprising a cap part and base part, connected by a solid hinge pin. Such an arrangement may be employed as described in the Specifications of the foregoing British Patents to control the inlet to and exhaust from an internal combustion engine in such a manner wherein a proportion of the combustion force in the cylinder is utilised to provide a self-adjusting, substantially no-clearance, seal between the valve member and its housing. Notwithstanding the effectiveness of the foregoing arrangement it has been found that the hinge pin which interconnects the cap and base parts of the split valve housing, because of its solidity, does tend to have a limiting effect on the adjustment of these two parts under variable thermal and mechanical loads. In operation, it can happen that one axial end of the valve tends to become hotter than the other and thereby to distort to a slightly conical shape the bore in which the valve member is received. This can in turn lead to leakage of gases or even seizure.

OBJECTS OF THE INVENTION.

It is a principal object of this invention to provide a rotary valve in which the valve housing is split into two parts and said parts are interconnected by means of an element allowing automatic adjustment of the parts about two axes at 90° to each other. It is thus an object to allow the diameter of the bore to be varied by uniform hinging of the two parts, as well as an adjustment of any conical angle of the bore, caused for instance by thermal or mechanical stresses.

It is a further object of this invention to provide a rotary valve which can be incorporated in an internal combustion engine to control the flow of gases to and from the combustion chamber. Furthermore, it is an object of the invention to provide a self-adjusting loading system for the two housing parts, which maintains a load on the cap part greater than the force produced by the combustion in the combustion chamber tending to lift the valve member from its seating.

These and other objects and advantages of this invention will become apparent from the following description of the invention.

SUMMARY OF THE INVENTION.

According to the broadest aspect of this invention, there is provided a rotary valve for controlling the passage of fluids, which valve comprises a valve housing formed from at least two relatively-movable parts and together defining a bore and fluid passageways communicating with the bore, and a valve member rotatably mounted in said bore in the valve housing to open and close said passageways on rotation of the valve member about a rotational axis, the two housing parts being held together in a fluid tight relationship and being interconnected by an element which allows relative hinging movement between said two housing parts about an axis substantially parallel to said rotational axis of the valve member, said element also allowing relative rocking movement between said two housing parts for adjustment of the separation of said two housing parts differentially at the two ends of said bore defined by said housing parts.

In the present invention, the solid hinge pin is replaced by an element arranged in operation of the valve to allow an extra degree of freedom of movement of the two valve housing parts. In this way, the cap and base parts of the split housing are effectively interconnected despite any thermal stresses and/or mechanical forces that may develop.

BRIEF DESCRIPTION OF THE DRAWINGS.

In order that the invention may be better understood, it will now be described in greater detail and certain specific examples thereof given though by way of example only, reference being made to the accompanying drawings. In the drawings.

DESCRIPTION OF THE PREFERRED EMBODIMENTS

Figure 1:
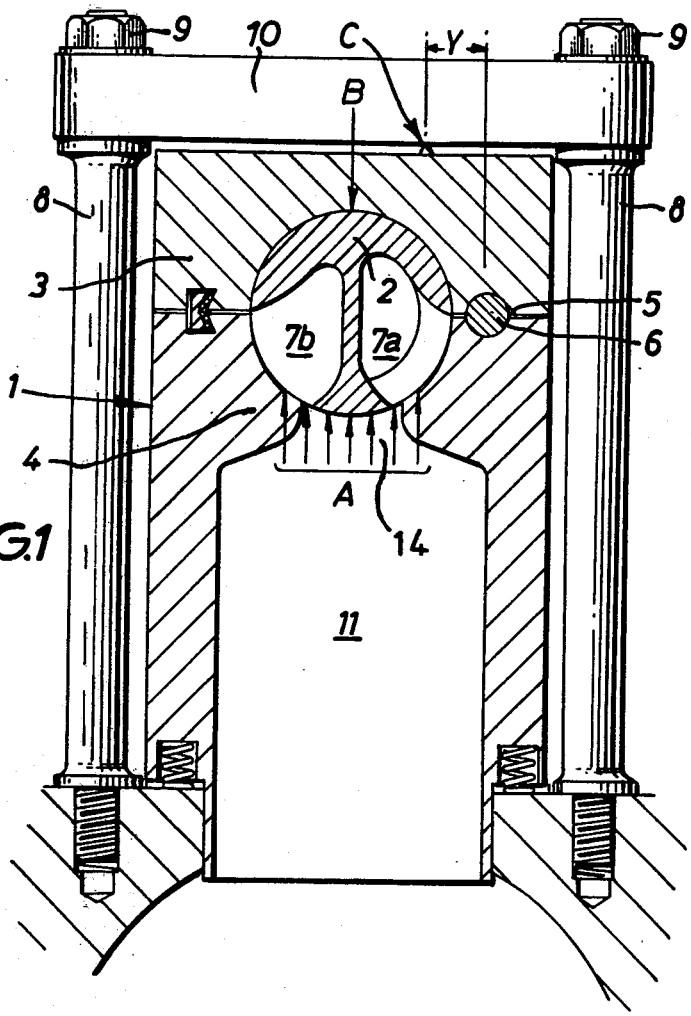
FIG. 1 is a vertical section through part of an engine fitted with a rotary valve having a controlled valve loading system, as illustrated in the Specifications of Patents Nos. 1473107, 1478982, 1481802 and 1481803 hereinbefore mentioned.

In the rotary valve of this invention, the element interconnecting the two housing parts must be arranged to allow a proper alignment therebetween. Said element may be in the form of two parallel pins of substantially semi-circular cross-section arranged with their plane faces opposed, each pin being located in a correspondingly-formed channel respectively in each housing part and extending parallel to the rotational axis of the valve member, a bearing member being provided between said two pins and means, such as pegs loosely fitting into bores in the pins and housing parts, being provided to restrain rotation of the composite element. Conveniently, the bearing member is upstanding from the plane face of one pin, either by machining of the pin or by attaching a separate pad on to the pin. Such an arrangement provides an extra degree of freedom allowing rocking movement to a limited extend between the two housing parts assisting in the proper operation of the valve as a whole.

In another form of the invention, the element may be in the form of two pins each of semi-circular cross-section and arranged with their plane faces opposed but their axes at an angle, and preferably 90°, to part-spherical recess another, each pin being received in a correspondingly-formed channel respectively in each housing part. Another possibility is for the element to be in the form of a part-spherical recess provided in one housing part and the element has a corresponding part-spherical surface, such as a half-ball, located in the recess. Yet another possibility is for the element to comprise co-operating first and second components, one component being attached to one of the housing parts and defining a part-spherical recess and the other component being attached to the other housing part and defining a part-spherical surface for engagement within the part-sphericalrecess to allow both hinging and rocking movement between said two housing parts.

The element interconnecting the housing parts may be lubricated from the general engine lubricating system or may be lubricated from a separate external source, or both; in either case pressure feeding may be used. The parts of the element should be of an appropriate material to withstand the operating conditions without undue wear, and for example nichrome steel may be used. If however, wear occurs, the element may be replaced relatively easily without the necessity for accurate and exact matching In a modification of rotary valve of the invention, the valve housing may be provided with a passageway in one housing part which communicates with the bore through the circumferential face thereof for registration with a port in the valve member, there being an insert let into the housing wall defining the bore to surround the opening to the passageway. Such an insert has the advantge of minimising gas leaks, and may be formed of a bearing material such as bronze.

The bearing surface of the walls of the housing defining the bore for the valve member may be dimpled in whole or in part; the dimples have the advantage of collecting debris from the valve face and preventing scoring.

When the invention is applied to an internal combustion engine, one part of the valve housing having an opening to the combustion chamber may be attached to or form a part of the cylinder or cylinder head, whereas the other part may form a cap clamped to the first-mentioned part by suitable means. The engine cylinder itself may be slidably mounted for movement along its axis and spring urged away from the crankcase towards the said other part. For such an arrangement, the two parts of the split valve housing may be retained in association for example by means of a beam bearing on the cap part of the housing, which beam is supported on the crankcase. Conveniently, the beam is adjustably mounted on pillars attached to the engine crankcase. The beam is adapted to take the reaction from combustion forces generated during combustion in the engine combustion chamber and transferred to the cap part of the housing by the valve member. There should be for such an arrangement a localised region of contact between the beam and the cap part of the housing, part-way between the rotational axis of the valve member and the element interconnecting the housing parts.

With this loading system there is a force obtained from the combustion forces (in operation of the engine) which acts directly on the valve member and tends to lift it from its seating around the opening to the combustion chamber in the one part of the split housing. This force (force A) can be expressed as follows:

$$\text{Force A} = \frac{\text{Total Combustion Force} \times \text{Area within valve member seating}}{\text{Cross Sectional Area of Cylinder}}$$

The reaction of this force is taken by the cap part of the valve housing, and transferred to the beam at a reaction point defined by said localised region of contact; this generates an opposing force (force B) on the cap part of the valve housing urging the valve member back on to its seating. By suitable selection of the placing of the interconnecting element between the two housing parts and of the reaction point, this force B can be arranged to be a predetermined amount greater than force A, e.g. from 8–15% greater, thereby maintaining contact between the valve member and the seating means.

Reference will now be made to the accompanying drawings to explain in greater detail the advantages of this invention as well as certain specific embodiments thereof.

Figure 2:
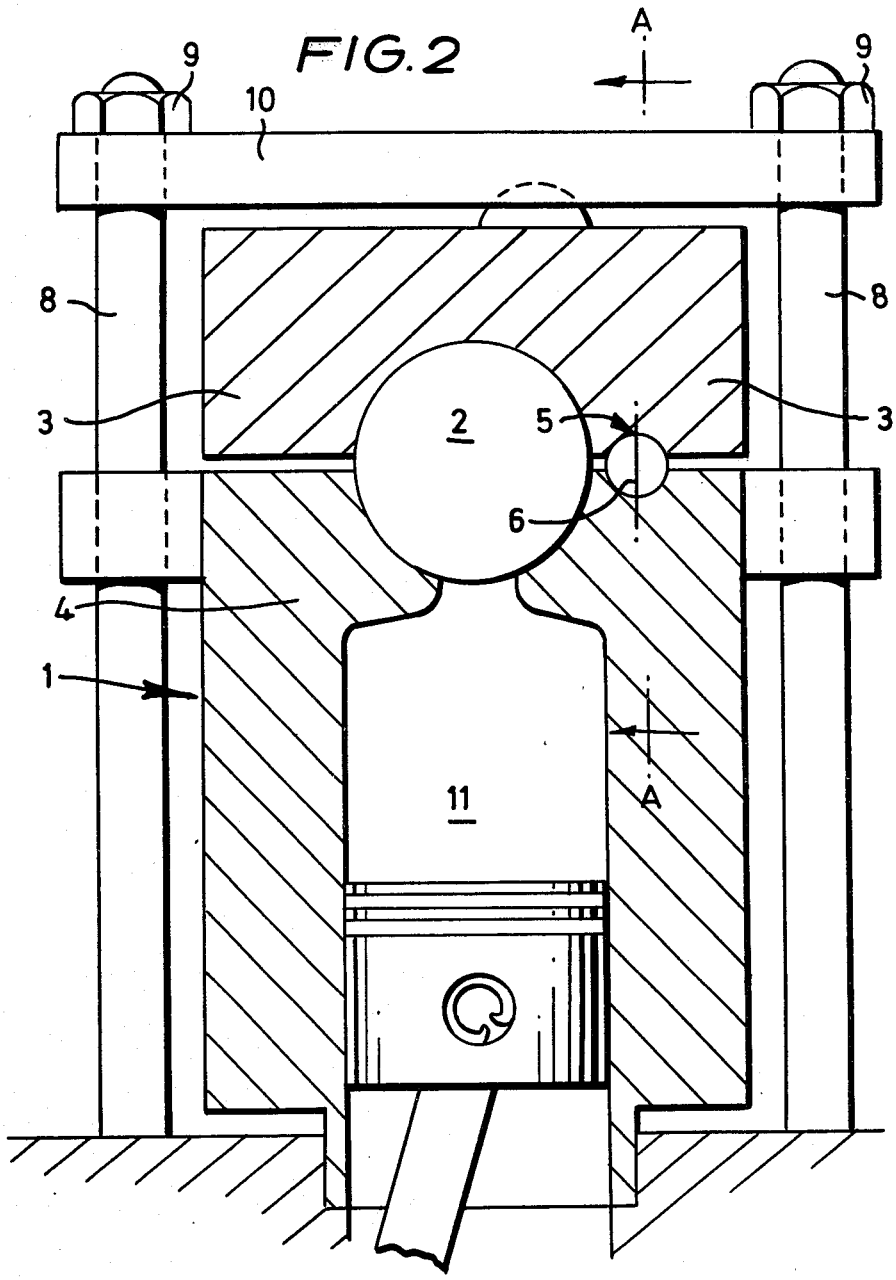
FIG. 2 indicates the principle of the engine of FIG. 1 in a simplified diagrammatic form.
Figure 3:
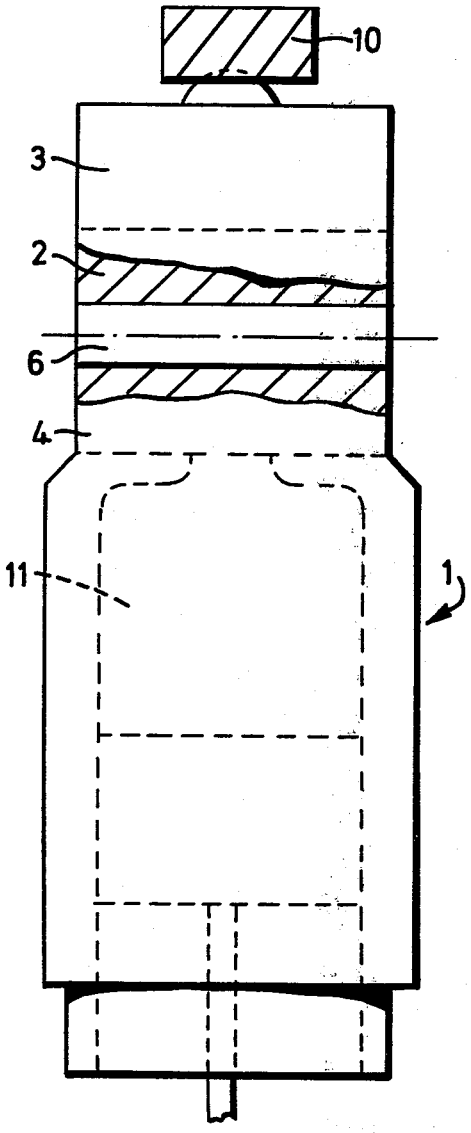
FIG. 3 is a section on line A—A of FIG. 2.

FIG. 1, 2 and 3 of the drawings show, for comparative purposes, a rotary valve having a controlled loading system, arranged in accordance with the prior art, as described in Patent Specifications Nos. 1473107, 1478982, 1481802 and 1481803. The remaining Figures illustrate various embodiments of rotary valve of this invention.

FIGS. 1 to 3 of the drawings shown a part of a reciprocating piston internal combustion engine having a rotary valve for controlling the inlet of combustible mixture to and the exhaust of combustion products from a cylinder 11. The valve comprises a valve housing 1, split diametrically into two parts 3 and 4 on a plane normal to the cylinder axis, and a valve member 2 rotatably mounted within a bore defined by the two housing parts. The upper, cap part 3 of the housing is hinged at 5 to the lower, base part 4 about a solid hinge pin 6, as shown in FIGS. 1, 2 and 3 of the drawings. Two pillars 8 are attached respectively at one of their ends to the engine crankcase whilst, at their other ends, they support a cross beam 10, clamped thereto by means of nuts 9. The beam 10 bears on the upper part of the cap 3 at C. The engine cylinder 11 is mounted in the crankcase so as to be able to move along its own axis and is biased, by suitable springs, towards the cross beam 10. Ports *7a* and *7b* are provided in thevalve member to come periodically into and out of registration with an opening 14 to the cylinder 11 on rotation of the valve member. Further passageways (not shown) are provided as required to carry gases to and from the valve member. A seal is arranged between the housing parts as shown to prevent leakage of gases.

When the engine runs, the combustion force developed in the cylinder produces a force A tending to lift the valve member from its seating on the lower part 4 of the housing. The reaction to this for A is taken at C on the cross beam 10 and the precise position of point C is selected to be at a distance Y from the centre line of the hinge 5 so that, by the principle of moments, the downward force B, regarded as being applied vertically on the axis of the valve member 2, exceeds the upward force A to prevent the valve member from being lifted from its seating. The precise excess of force B over force A can be predetermined to be a required amount for proper sealing by selecting the position of C (see FIG. 1).

It will be appreciated that the cap part 3 may hinge about the axis of pin 6 relative to the base part 4 of the housing, and clearances taken up thereby between the bore in the housing and the valve member. However, thermal and mechanical loads can lead to seizure, if for example the bore becomes slightly conical owing to greater stresses at one end than at the other.

Figure 5:
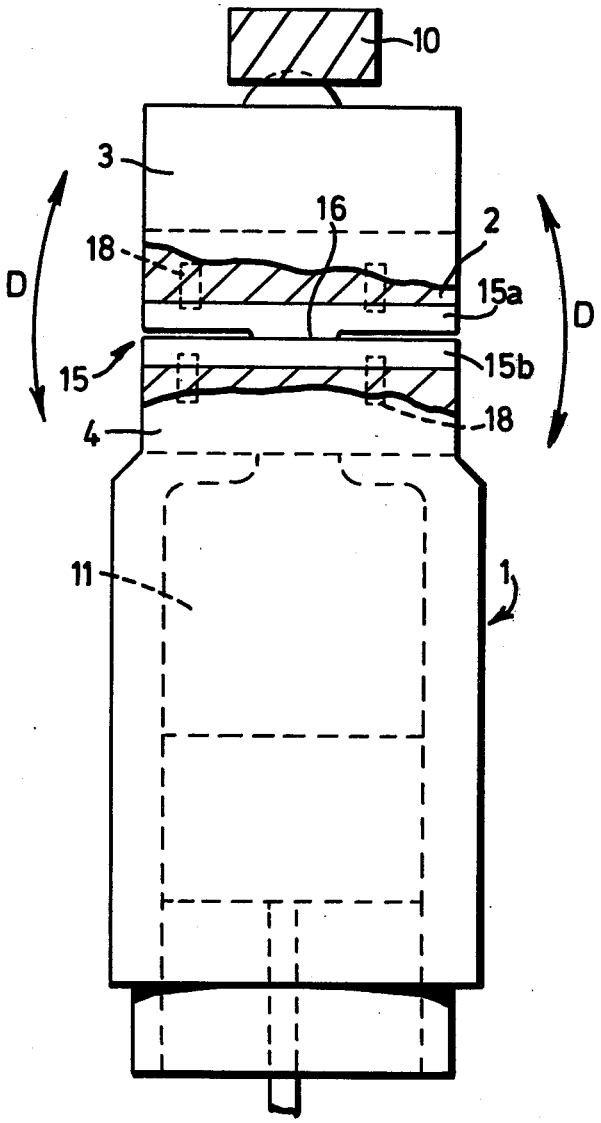
FIG. 5 is a sectional view on line B—B of FIG. 4.
Figure 4:
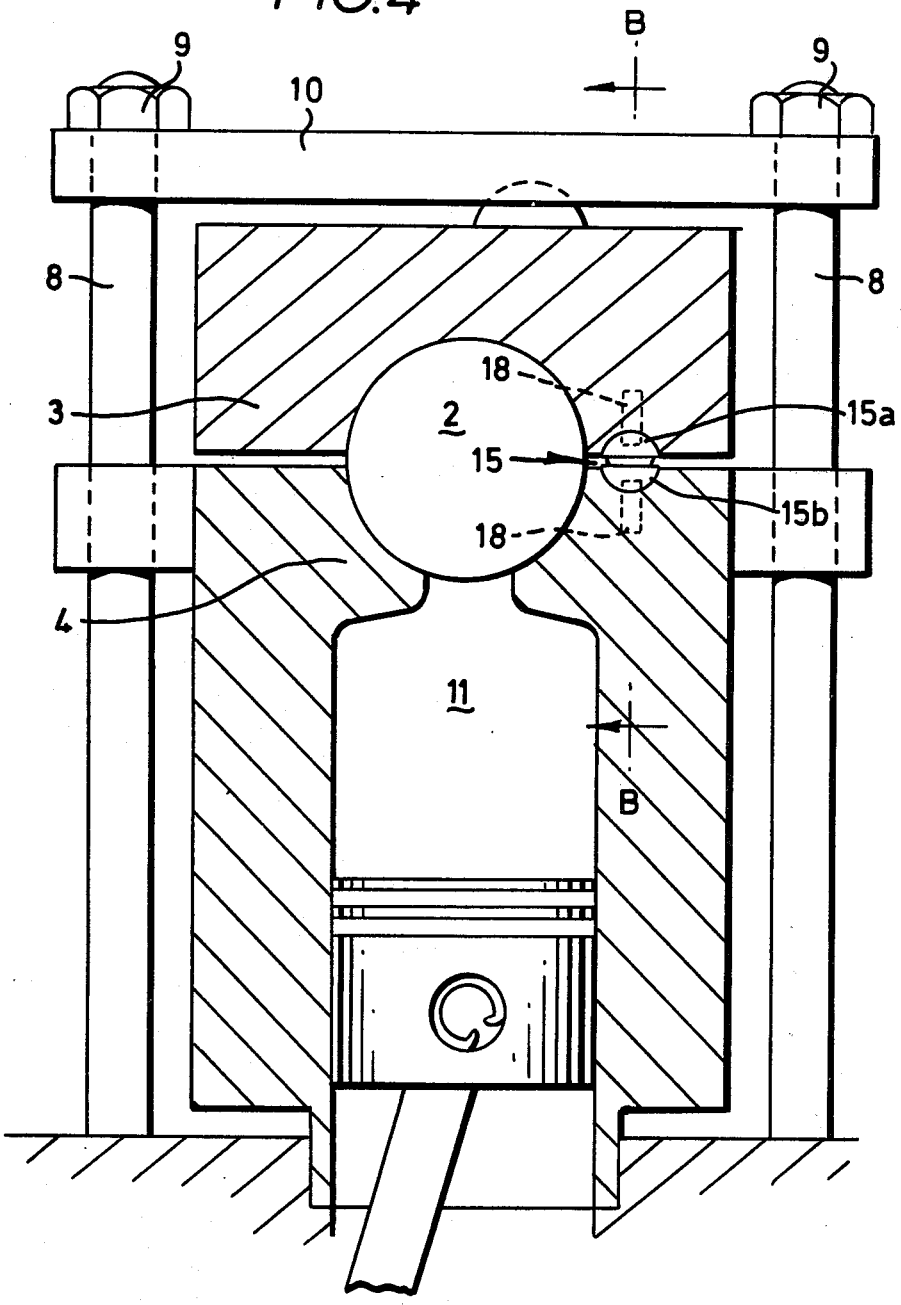
FIG. 4 illustrates diagrammatically, in vertical section, one form of rotary valve of the present invention.

Referring now to FIGS. 4 and 5, a pegs embodiment of this invention is shown, which is generally similar to that just-described, and like parts are given like reference characters. However, the solid hinge pin 6 shown in FIGS. 1 to 3 is replaced by a two piece pin 15, the two pieces of which are respectively located in grooves in the two housing parts. The upper pin piece 15*a* is relieved to each side of a central portion 16 to the free ends of the pin piece, thereby to define a bearing pad which bears on the plane face of the lower pin piece. Loose-fitting pega 18 are provided in the bores in both the housing parts and the associated pin pieces to prevent rotation therebetween.

In this embodiment, the upper housing part 3 may both hinge about the hinge pin axis parallel to the rotational axis of the bore and rock about the central portion 16, as shown by arrows D. In this way, the effective diameter of the bore may adjust by the former hinging movement and the effective diameters at the two ends of the bore may adjust differentially by the latter rocking movement. Excess thermal or mechanical stresses may thus be accommodated automatically and the two housing parts are self-adjusting to fit closely around the valve member for a wide range of operating conditions.

Figure 6:
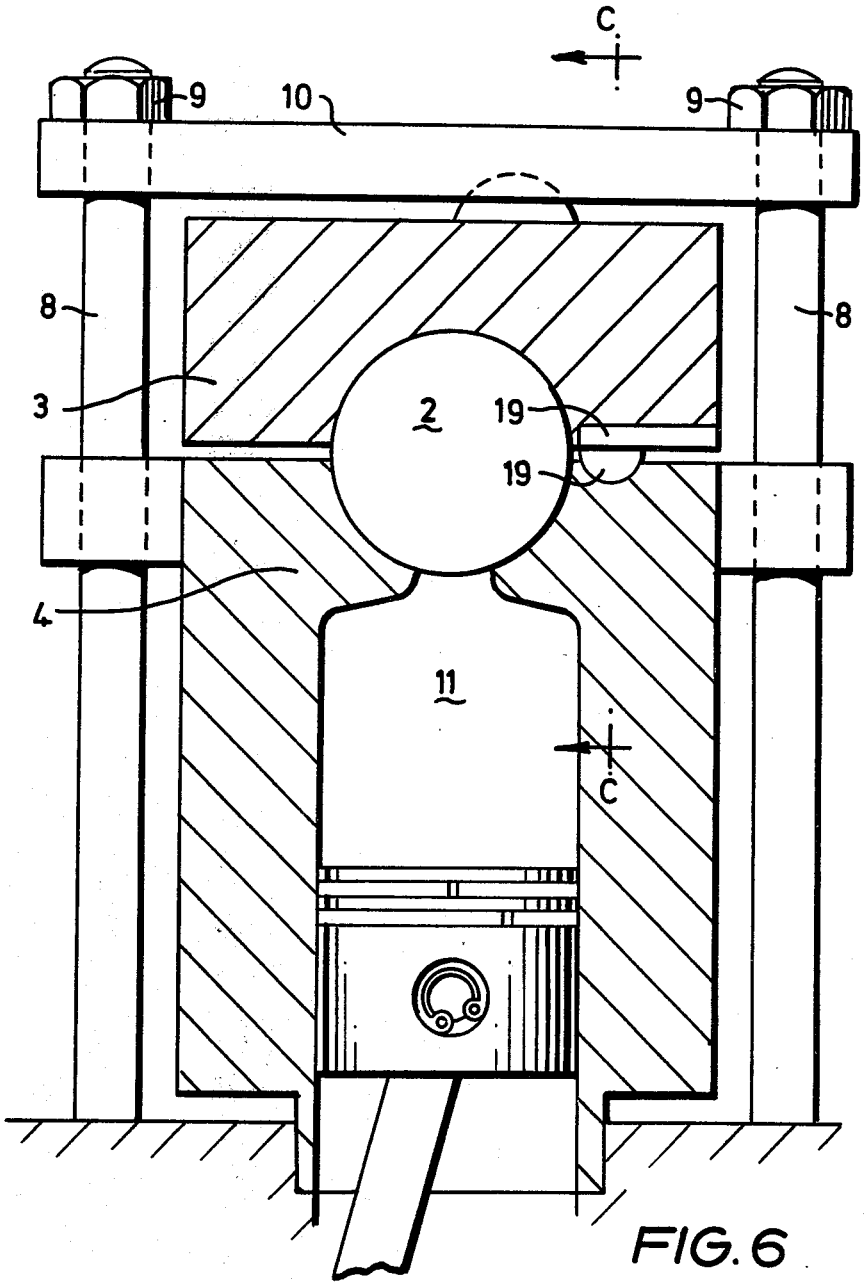
FIG. 6 is a diagrammatic vertical section of a rotary valve of this invention having another form of interconnecting element.
Figure 7:
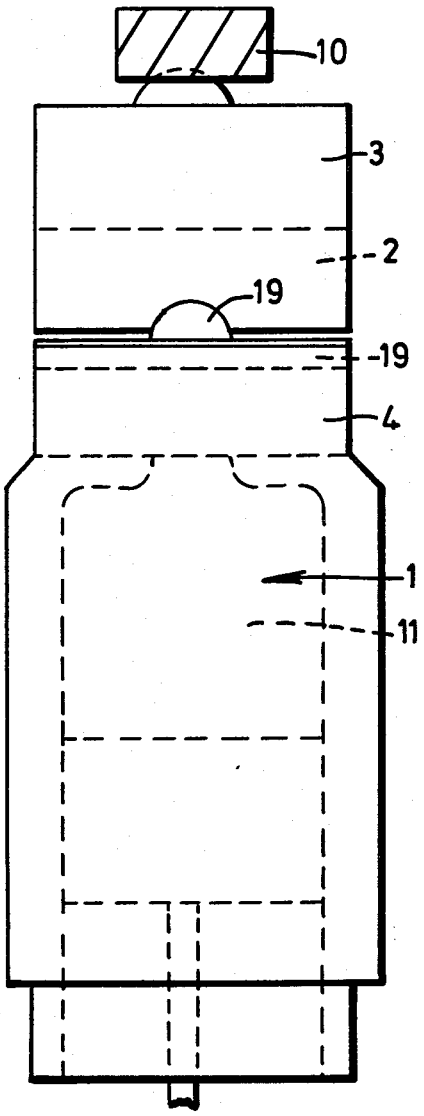
FIG. 7 is a view on line C—C of FIG. 6.

FIGS. 6 and 7 show an alternative arrangement to the split hinge pin 15 of FIGS. 4 and 5, like parts to FIGS. 1 to 3 again being given like reference characters. The element interconnecting the two housing parts comprises two half round pins 19 disposed with their plane faces in contact but with their axes at an angle of 90° to each other. The two pins are received in correspondingly shaped and disposed recesses respectively in the two housing parts, whereby the cap part 3 may adjust both by hinging and by rocking with respect to the base part 4.

Figure 9:
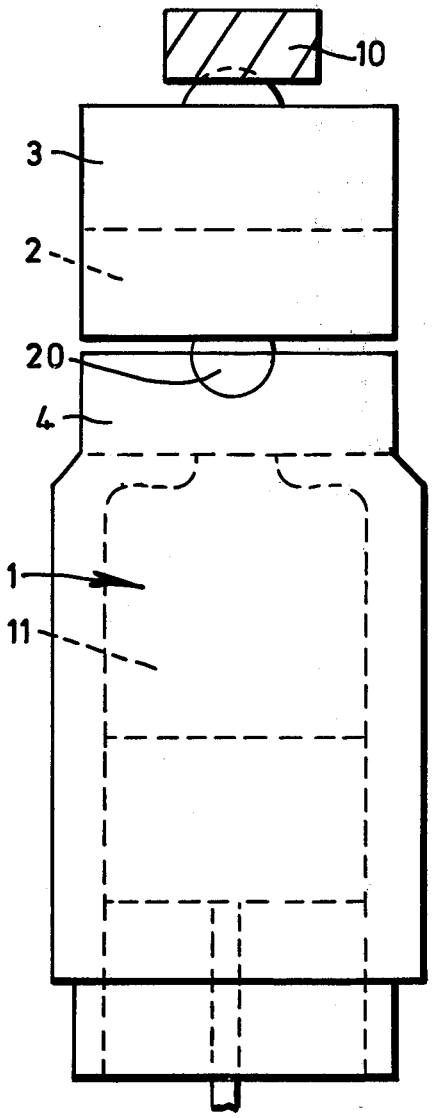
FIG. 9 is a sectional view on line D—D of FIG. 8.
Figure 8:
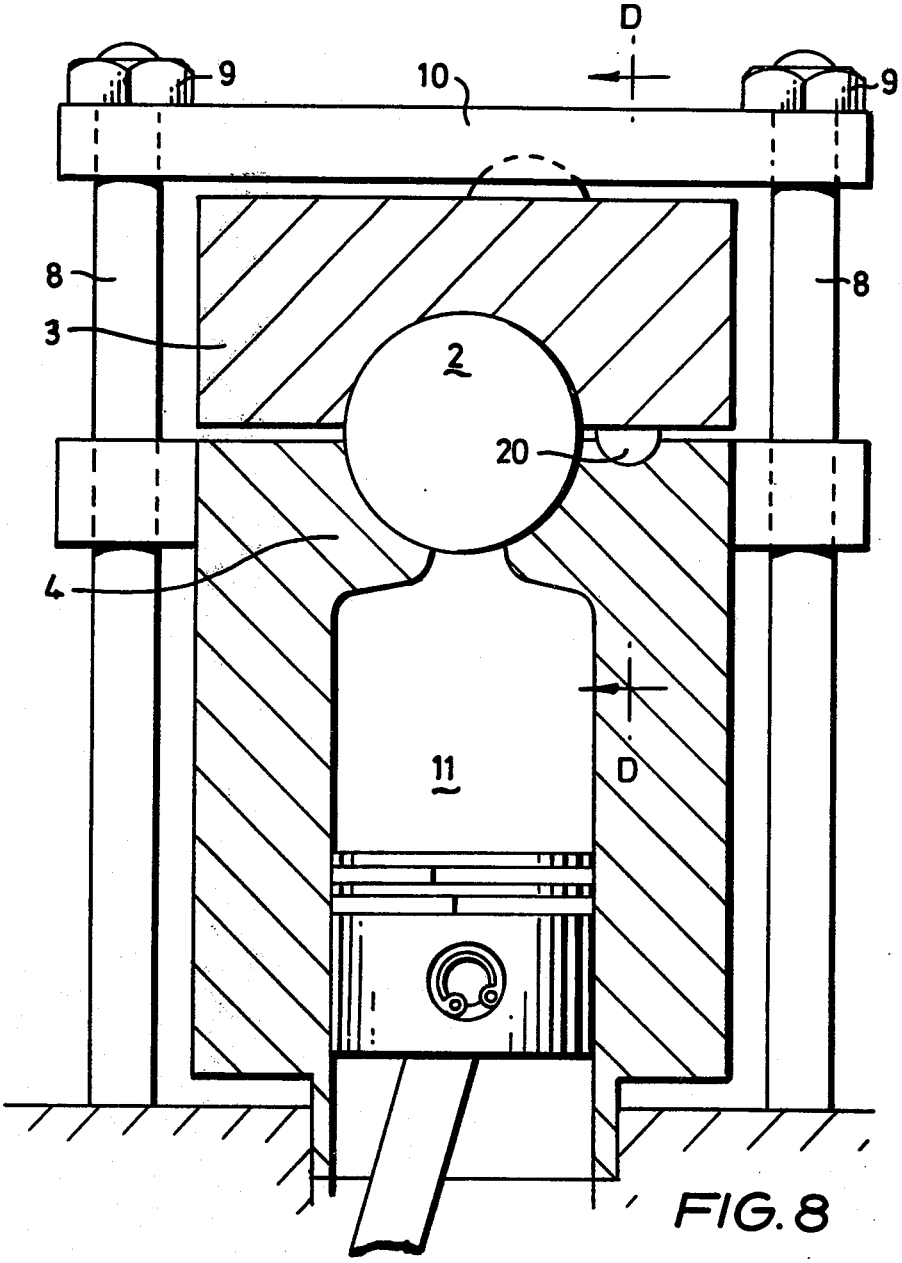
FIG. 8 is a still further form of rotary valve of the invention.

FIGS. 8 and 9 show a further modification of the invention in which the element interconnecting the two housing parts comprises a semi-spherical ball 20, located in a part-spherical recess in the base housing part 4. The plane upper surface of the ball is appropriately connected to the cap part 3. It will be appreciated that the co-operating semi-spherical ball and part-spherical recess allow the cap part to move relative to the base part in both the aforementioned hinging and rocking directions. Moreover, complex movements are also possible since the co-operating surfaces do not define any particular axes for movement.

Figure 10:
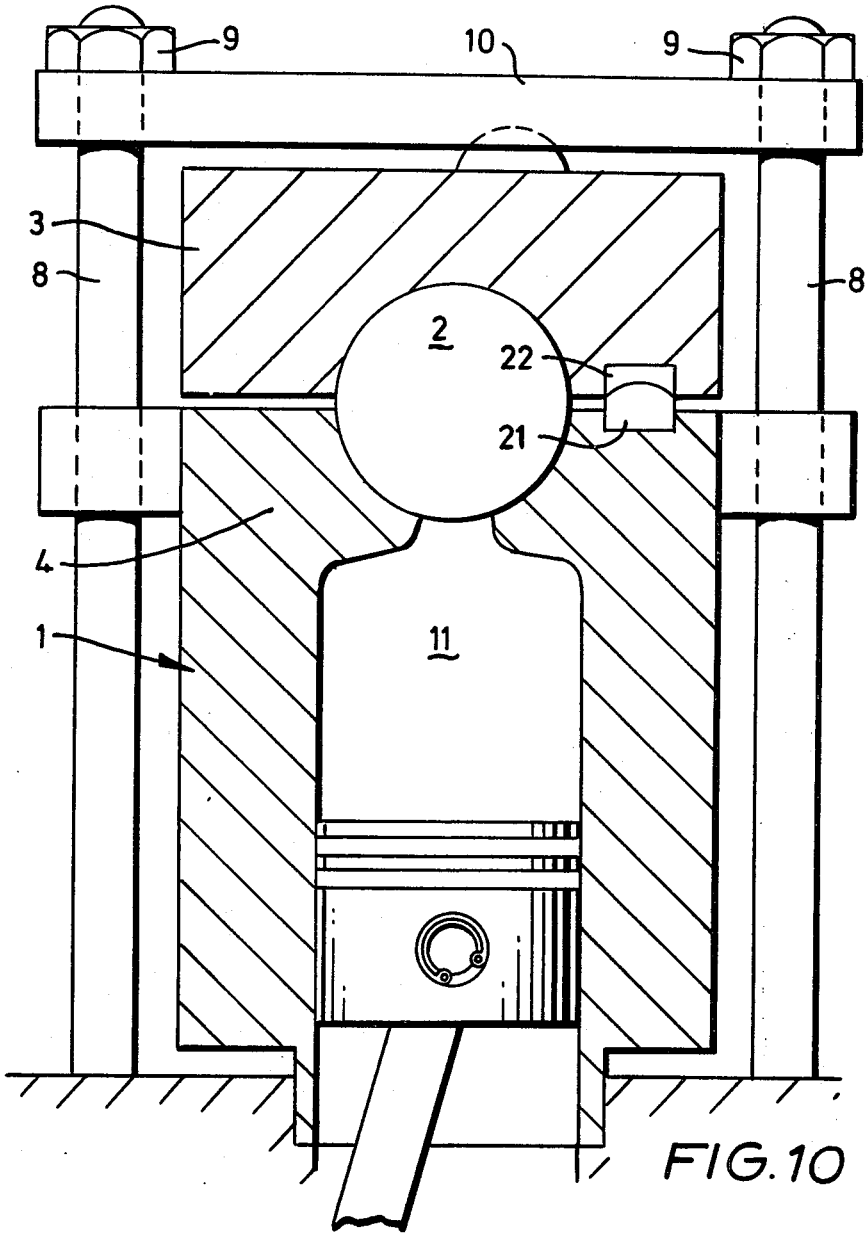
FIG. 10 illustrates yet another form of rotary valve of the invention.
Figure 11:
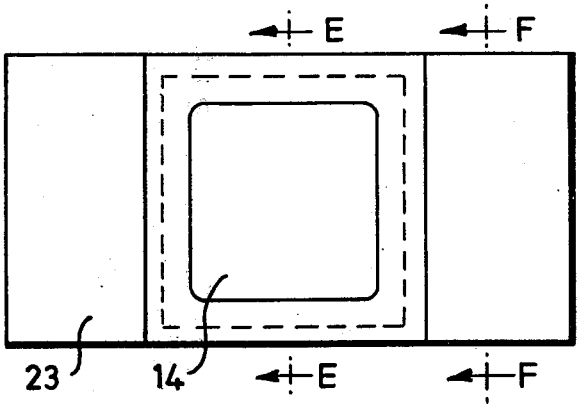
FIG. 11 is a front view of an insert for use with the rotary valve of this invention, for location in the valve member bore.
Figure 12:
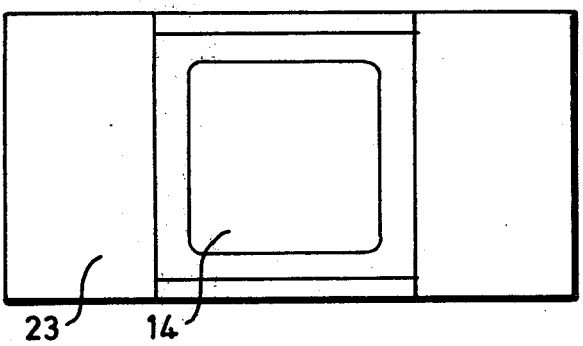
FIG. 12 is a rear view of the insert of FIG. 11.

FIG. 10 shows a still further modification in which the element interconnecting the two housing parts comprises first and second components 21 and 22, respectively attached to the two housing parts. Component 21 defines an upstanding part-spherical surface which is received in a part-spherical recess in component 22; the degrees of freedom of this arrangement are similar to those of the preceding embodiment.

FIGS. 11 to 14 show an insert 23 which may be fitted into a recess provided around the opening 14 in the base housing part to the combustion chamber 11. The insert is bevelled on its outer face along the edges 24 adjacent the opening 14, and on its inner face, the insert is relieved in the immediate vicinity of the opening, as can be seen from FIG. 14. The provision of an insert assists in the minimising of gas leaks between the rotary valve member and the insert, as well as assists in the smooth running of the valve member by providing a bearing surface for the reaction force deriving from the excess of force B over force A (see FIG. 1).

Figure 15:
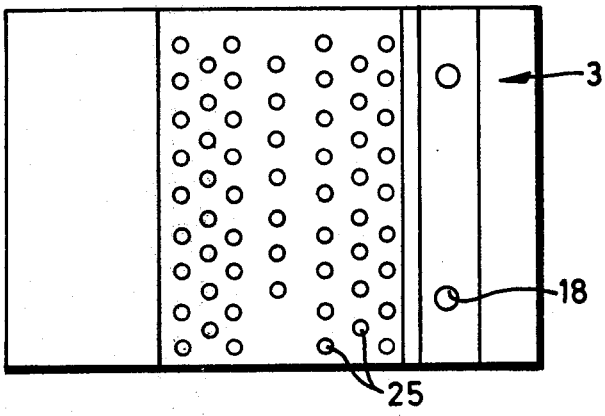
FIG. 15 is an underplan view on the cup part of a rotary valve of this invention.
Figure 14:
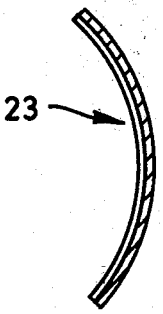
FIG. 14 is a view on line F—F of FIG. 12.
Figure 13:
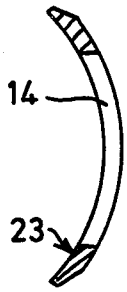
FIG. 13 is a section on line E—E of FIG. 12.

FIG. 15 shows part of a cap part of a valve housing of this invention, and it can be seen that the bore is provided with a series of dimples 25 thereover. These dimples assist in the lubrication of the valve member and also serve to trap any debris resulting for instance from the carbonisation of lubricant. Such a surface thus also assists in the prevention of scoring of the valve member.

Where the invention is employed in association with internal combustion engines, it is not limited to the combustion of fuels in engines fitted with reciprocating pistons such as are described above. For instance certain types of rotary piston engines, such as the Codey having a clover leaf cylinder, or an epitrochoid chamber as in the Wankel engine, can employ a separate valving arrangement which may take the form defined by this invention. This is of particular importance in high pressure machines, or where the local heat flux imported to the area of the working cylinder would be excessive if rotary piston seals were interrupted by porting, as in the Wankel engine where seal melting can occur.

When the valve is used by an internal combustion engine, it must be lubricated, and a copious amount of lubricant is preferably supplied to the interface between the valve member and the valve housing at a suitable position to lubricate the valve member as it rotates after is has passed the opening into the combustion chamber, excess lubricant being removed from the valve member before lubricant can be carried by valve rotation into the combustion chamber.

Special seals are preferably arranged to seal the valve member port when it is in communication with the opening to the combustion chamber. For example, upstanding lips may be provided within the housing round the opening to engage with and effect a seal against the rotatable valve member. The function of the lips is to seal the valve housing to the valve member in the region of the opening, whereby the ingress of lubricant to the combustion chamber of an engine can be significantly reduced and whereby more efficient combustion of fuel in the combustion chamber can be achieved, with a consequent reduction of the emission of unburned, or incompletely burned, fuel through the exhaust system.

Alternatively, or in addition to the foregoing lips, a seal may be formed by providing seal means in the rotary valve member. For a cylindrical rotary valve member, this form of sealing may comprise at least two circumferential sealing rings mounted in the valve member, one on each side of a port therein for sealing against the valve housing. Additionally at least two sealing strips may be disposed in the valve member parallel to its axis of rotation, one on each side of the port in the valve member, for sealing against the face of the valve housing. In this way the port in the valve member is surrounded by sealing strips and, if required, these can be resiliently urgedoutwardly to bear on the face of the valve housing.

Instead of upstanding lips in the housing, there may be provided one or more sealing elements around the opening in the face of the valve housing for sealing against the valve member. Although this form of the invention could be applied to a cylindrical rotary valve member, it finds particular use in connection with a rotary valve having a spherical, or part-spherical, valve member. In a similar way, sealing elements could, instead, be provided around the port in the face of the valve member, for sealing against the valve housing.

The above-mentioned sealing and lubricating arrangements for the valve member of the rotary valve of this invention have been discussed and claimed in greater detail in British Patent Specifications Nos. 1473107, 1478982, 1481802 and 1481803, through of course only in connection with a split valve housing having its two parts interconnected by means of a solid hinge pin. The various aspects of those sealing and lubricating arrangements are equally applicable to the rotary valve of the present invention, though they are not described in detail here and reference should be made to the earlier British Patent Specifications for a complete discussion of them.

What is claimed is:

1. A rotary valve for controlling the passage of fluids, which valve comprises a valve housing formed from at least two relatively-movable parts and together defining a bore and fluid passageways communicating with the bore, and a valve member rotatably mounted in said bore in the valve housing to open and close said passageways on rotation of the valve member about a rotational axis, the two housing parts being held together in a fluid tight relationship and being interconnected by an element which allows relative hinging movement between said two housing parts about an axis substantially parallel to said rotational axis of the valve member, said element also allowing relative rocking movement between said two housing parts for adjustment of the separation of said two housing parts differentially at the two ends of said bore defined by said housing parts.

2. A rotary valve as claimed in claim 1, in which said element comprises two parallel pins each of substantially semi-circular cross-section arranged with the plane faces thereof opposed, said two housing parts each having a channel of substantially semi-circular cross-section in which is received one pin respectively, said channels extending parallel to the rotational axis of the valve member, a bearing member being provided between said two pins, and means being provided to restrain rotation of said element in said channels.

3. A rotary valve as claimed in claim 2, in which said bearing member comprises a pad upstanding from said plane face of one of said pins.

4. A rotary valve as claimed in claim 2, in which said means to restrain rotation comprise registering bores in both the pins and the associated housing parts, and pegs loosely located in said bores.

5. A rotary valve as claimed in claim 1, in which said element comprises two pins each of semi-circular cross-section and arranged with their plane faces attached to each other but the axes of the pins at an angle of 90° to one another, and said two housing parts each having a channel of substantially semi-circular cross-section in which is received one pin respectively.

6. A rotary valve as claimed in claim 1, in which a part-spherical recess is provided in one said housing part and said element has a corresponding part-spherical surface located in the recess.

7. A rotary valve as claimed in claim 6, in which said element is in the form of a half-ball, the plane circular face of the half-ball bearing on the other housing part.

8. A rotary valve as claimed in claim 1, in which said element comprises co-operating first and second components, one component being attached to one of said housing parts and defining a part-spherical recess and the other component being attached to the other of said housing parts and defining a part-spherical surface for engagement within the part-spherical recess to allow both hinging and rocking movement between said two housing parts.

9. A rotary valve for controlling the inlet of gases to and the exhaust of combustion products from a combustion chamber of an internal combustion engine, which rotary valve comprises a valve housing formed from two relatively movable parts and together defining a bore and a passageway communicating the bore to said combustion chamber, a valve member rotatably mounted within said bore in the valve housing and having at least one port which periodically comes into and out of registration with the passageway on rotation of the valve member about the rotational axis thereof, and means to load said two housing parts in a controlled manner to urge said parts together dependent upon combustion forces in said combustion chamber, said two housing parts being held together in a fluid tight relationship and being interconnected by an element which allows relative hinging movement between said two housing parts about an axis substantially parallel to said rotational axis of the valve member, said element also allowing relative rocking movement between said two housing parts for adjustment of the separation of said two housing parts, differentially at the two ends of said bore defined by said parts.

10. A rotary valve as claimed in claim 9, in which said combustion chamber is cylindrical and said two parts of the valve housing mate on a plane normal to the cylindrical axis of the combustion chamber and containing the rotational axis of the valve member.

11. A rotary valve as claimed in claim 9, in which there is a passageway in one of said housing parts which communicates with said bore through a circumferential wall element of said one housing part for registration with a port in the valve member, there being an insert let into said circumferential housing wall defining the bore to surround the opening to the passageway.

12. A rotary valve as claimed in claim 1, in which the housing walls defining the bore are provided with dimples over at least a part of the area thereof.

13. A rotary valve for controlling the flow of inlet gases to and combustion products from the combustion chamber of an internal combustion engine, which valve comprises in combination an internal combustion engine cylinder having a cylinder axis, a base valve housing part formed as a part of said cylinder a cap valve housing part mounted on said base valve housing part with the join therebetween lying in a plane normal to said cylinder axis, the base and cap housing parts together defining a bore, an opening in the base housing part and communicating said bore to said cylinder, a rotatable valve member fitted within said bore and having at least one port which comes into and out of registration with said opneing on rotation of said valve member about a rotational axis, an engine crankcase which slidably supports said cylinder for movement parallel to said cylinder axis, loading means anchored to said crankcase and bearing on said cap part to load said cap part against said base part, resilient means to urge said cylinder away from said crankcase thereby to maintain engagement between said loading means and said cap part, and an element interconnecting said base and cap parts which element allows relative hinging movement between said two housing parts about an axis substantially parallel to said rotational axis of the valve member, said element also allowing relative rocking movement between said two housing parts for adjustment of the separation of said two housing parts differentially at the two ends of said bore defined by said housing parts, whereby said loading means applies a force to said cap part dependent upon the combustion forces in said cylinder to urge said valve member into engagement with said base part.

14. A rotary valve as claimed in claim 13, in which said loading means bears on said cap part at a location intermediate said rotational axis of said valve member and said axis of hinging movement of said two parts.

* * * * *